United States Patent [19]

Brückner et al.

[11] Patent Number: 4,623,130

[45] Date of Patent: Nov. 18, 1986

[54] REFRACTORY MEMBER FORMED OF FIBER MATERIAL FOR USE IN SLIDING CLOSURE UNIT

[76] Inventors: Raimund Brückner, Bremthaler Weg 7, 6238 Hofheim/Wildsachsen; Axel Eschner, Wilhelm-Busch-Str. 3, 6719 Göllheim; Hermann Leupold, Erickaweg 28, 6229 Walluf, all of Fed. Rep. of Germany

[21] Appl. No.: 522,648

[22] Filed: Aug. 11, 1983

[30] Foreign Application Priority Data

Aug. 13, 1982 [DE] Fed. Rep. of Germany ..... 3230107

[51] Int. Cl.[4] ..... B22D 41/08

[52] U.S. Cl. ..... 266/271; 266/287; 222/600

[58] Field of Search ..... 266/280, 286, 275, 272, 266/236, 281, 45, 287; 222/600, 590, 591, 597

[56] References Cited

U.S. PATENT DOCUMENTS

| | | | |
|---|---|---|---|
| 3,540,627 | 11/1970 | Armstead | 266/272 |
| 3,917,110 | 11/1975 | Kiguchi | 266/280 |
| 4,010,936 | 3/1977 | Takashima | 266/45 |
| 4,220,268 | 9/1980 | Fehling | 222/600 |
| 4,381,855 | 5/1983 | Ryan | 266/287 |
| 4,432,396 | 2/1984 | Daussan et al. | 222/591 |

*Primary Examiner*—L. Dewayne Rutledge
*Assistant Examiner*—S. Kastler
*Attorney, Agent, or Firm*—Wenderoth, Lind & Ponack

[57] ABSTRACT

A sliding closure unit includes a pair of spaced guide members and a discharge control member movable between the guide members. The control member has therethrough at least one discharge opening to be moved into or out of alignment with discharge openings through the guide members. The control member is formed of a ceramic fiber material.

38 Claims, 14 Drawing Figures

VII
VII
5
6
31
35
36
37
38
39
41
42
43
44
45

REFRACTORY MEMBER FORMED OF FIBER MATERIAL FOR USE IN SLIDING CLOSURE UNIT

BACKGROUND OF THE INVENTION

It is known that the wear parts of sliding gate valves, i.e. closure units, are subjected to extraordinarily high erosive and/or corrosive attacks. Such wear parts presently are formed of very high value ceramic refractory materials which, however, are subject to unsatisfactorily high wear and tend to the formation of cracks at extreme thermal stresses. There is further the danger with such sliding gate valves of conventional type of the freezing of the metal in the through passages when the sliding gate valve is closed. These disadvantageous phenomena depend in part on the thermal conductivity and insulating properties of the refractory material of the wear part.

SUMMARY OF THE INVENTION

It is the object of the present invention to provide such wear parts that better resist the erosive and/or corrosive stresses and eliminate the danger of freezing of the metal melt. It is also the object of the present invention to provide a sliding closure unit which is operable in a simple manner and which includes such novel wear parts.

The invention resides in the use of ceramic fiber material for wear parts, e.g. plates and sleeves in sliding gate valves or closure units, coming into contact with a liquid metal melt, in particular steel melt, which has a density between 1.5 and 3 g/cm$^3$, preferably of 2 g/cm$^3$. The term "fiber material" embraces a material comprising substantially or only partially fibers.

Thermally insulating materials, for instance on the basis of carbon or graphite fibers, are known per se, as are thermally insulating plates of compressed rock wool or the like in which for instance heat-resistant materials, such as fire clay, mineral wool cement or asbestos, are embedded.

With the present invention refractory ceramic fiber materials are employed in a completely new field of use. The invention is the formation of refractory wear parts for certain purposes from a material which is new for these purposes, namely ceramic fiber material.

Wear parts may be produced in a simple manner from the ceramic fiber material, which in the combinations envisaged can withstand the high erosive and/or corrosive stresses which are present in, for instance, a sliding gate valve. The wear parts formed in accordance with the invention from the ceramic fiber material have not only an adequate resistance to such attacks, but also the necessary strength and abrasion resistance in the cold and in the hot states, suitable porosity, cold compression strength, cold bending strength and hot bending strength, in particular satisfactory chemical resistance to aggressive steels and slags, low tendency to splitting away of the surface or the edge of the through opening acting as a throttle edge, high resistance to changes in temperature and high flame resistance (peeling test). The refractory ceramic fiber material impedes crack formation even under such stresses, and the parts or members formed thereof can further be given good thermal conductivity or good thermal insulation properties by reason of the fiber material and the possible fiber orientation. The latter properties are particularly important for heat distribution in sliding plates and the avoidance of the freezing of the metal melt. Ceramic fiber materials also have a poor wettability for metal melts which is to the benefit of resistance to erosion and corrosion.

The fiber material preferably contains alumina fibers or fiber mixtures, e.g. fibers of $Al_2O_3.SiO_2$.

The content of $Al_2O_3$ of the alumina fibers or fiber mixtures is conveniently greater than 45 wt. % and smaller than 98 wt. % or greater than 60 wt. %, preferably greater than 75 wt. %, and smaller than 98 wt. %.

The fiber material can slso comprise fibers on the basis of $ZrO_2$ or carbon or contain fiber additives of carbon and/or $Cr_2O_3$ and/or $ZrO_2$ and/or MgO containing fibers.

To influence thermal conductivity, the fiber material can contain additions of highly heat resistant metal fibers, preferably with a diameter and length of the order of those of the ceramic fibers.

The ceramic fibers preferably have an average length of less than about $1\times10^{-3}$ m and preferably an average diameter of less than about 3 to $5\times10^{-6}$ m.

To form the wear parts the fiber material can be mechanically and/or thermally compressed and/or strengthened.

The fiber material can be pressed and/or a felt.

For bonding, a refractory organic and/or inorganic, preferably carbon containing or carbonisable, bonding agent, preferably up to 60% tar or pitch, can be embedded in the fiber material.

The fiber material is preferably soaked with tar or pitch.

To influence the physical properties of the fiber material, there further can be added thereto between 0 and 30 wt. %, preferably 0 to 10 wt. %, pulverulant or colloidal refractory additives, e.g. $Al_2O_3$, MgO, CaO, $SiO_2$, $SrO_2$, SiC, $Cr_2O_3$ or graphite.

In order further to reduce the attack by the metal melt, the fiber material can have a refractory wetting-inhibiting agent.

Particularly when the fiber material is constructed as a plate shaped closure or control element for a sliding closure unit, it is convenient if the fiber material has a refractory lubricant, e.g. graphite or a carbon or molybdenum compound.

Wear resistance and/or thermal conductivity and/or sliding ability of the fiber material can also be improved if the fibers or the surfaces of the fiber material are wholly or partly vapour deposited with highly wear resistant metal or metal oxide compounds.

The fiber proportion of the fiber material should be between about 40 and 90 wt. %.

The fiber material intended for the invention conveniently has a cold bending strength between about 4 and 10 N/mm$^2$ and a hot bending strength at 1500° C. of between about 3 and 8 N/mm$^2$.

The fiber material is preferably constructed as a plate-shaped control and/or shut-off member for a sliding closure unit. It must then have a cold bending strength between about 4 and 10 N/mm$^2$, preferably 6 and 10 N/mm$^2$, and a hot bending strength at 1500° C. of between about 3 and 8 N/mm$^2$. Such control and/or shut-off members have comparatively large dimensions and are therefore particularly subject to the dnager of cracks which are avoided with the invention.

The fiber material can itself also serve as a carrier for ceramic inserts of ceramic fiber material and/or other refractory wear materials known per se.

A sliding gate valve for vessels containing liquid metal melts, in particular a steel melt, with a closure and/or control element which is displaceable between two guide planes and having at least one through opening is characterised in accordance with the invention in that the closure or control element is constructed in the shape of a web of fiber material as discussed above and has through openings spaced apart from one another over its length. That the closure or control element may be guided in a straight or in a curved manner between guide surfaces formed between, e.g., plates and is compressible to a satisfactory strength to accommodate the ferrostatic pressure.

In an inventive development of such a sliding gate valve the guide surfaces form a feed gap bounded by sealing surfaces which may be spread apart, e.g. against the action of springs, whereby the web shaped fiber material is compressible on introduction into the feed gap to produce an engagement pressure sufficient for sealing.

The engagement pressure can be constituted partially by the thermal expansion of the closure or control element occurring on introduction of the closure or control element between the sealing surfaces. The closure or control element is in any event preferably flexible before its compression so that it can be stored on a roller and drawn into the sliding gate valve gap from such roller.

For the introduction of the web shaped closure or control element, it is convenient to provide special tension-resistant inserts and/or overlays in or on the web, for example formed of heat resistant metal.

The inserts and/or overlays are preferably not rigid, but rather are flexible or jointed.

In order to facilitate the introduction of the closure or control element into the feed gap of the sliding gate valve, the closure or control element can have on one or both sides thereof a layer with an embedded lubricant, e.g. graphite.

A particularly favourable control of the metal flow from the respective metallurgical vessel can be achieved if successive through openings in the web have increasing cross-sections corresponding to a reduction of the ferrostatic pressure in the vessel during emptying thereof.

As the web-shaped fiber material is moved between the guide plates, successive through openings of increasing cross-section are brought into alignment with the through openings of the bounding guide plates as the ferrostatic pressure decreases, whereby the flow of the metal melt can be held approximately constant. The web-shaped control and/or shut-off element in accordance with the invention thus replaces the middle plate of the known so called three plate sliding closure unit. With the aid of the compressibility of the fiber material a good joint seal of the sliding gate valve may be achieved. The closure or control element of the present invention operates initially with a first through opening cooperating with the through passages of the two bordering guide plates. After the first discharge from the container of metal melt by the sliding gate valve, the closure or control element can be moved so that its second through opening is in the region of the through passages of the bordering guide plates. Each through opening thus has a control or shut-off function with its edge, for instance with only a single vessel emptying. The closure or control element can thus be maintained relatively thin.

DETAILED DESCRIPTION OF THE INVENTION

The above briefly described drawings are provided as illustration of the above discussed features of the present invention.

Figure 1:
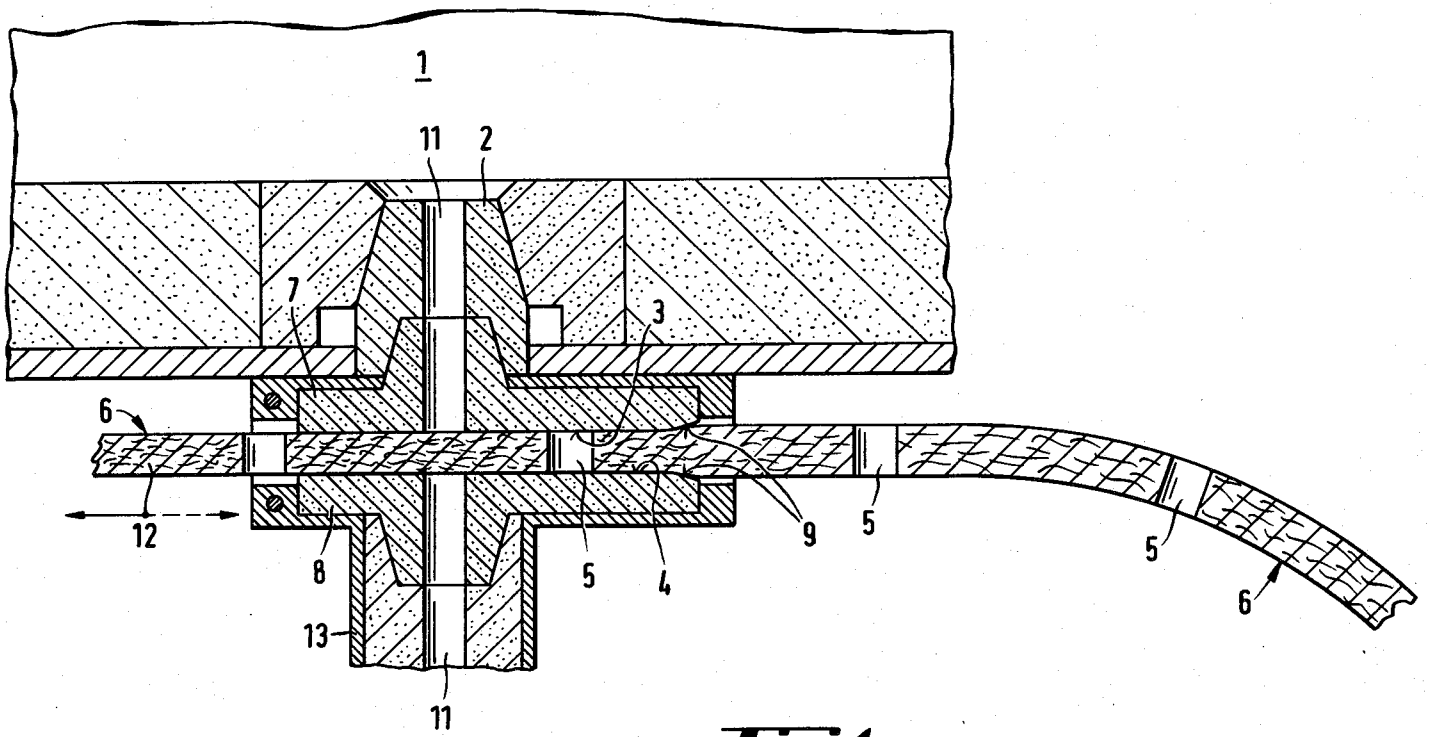
FIG. 1 is a cross-section through a sliding closure unit incorporating a web of ceramic fiber material according to the present invention.

FIG. 1 shows a metallurgical vessel 1 having a metal casing and a refractory lining provided with a perforated brick 2. A sliding closure unit includes fixed refractory plates 7, 8 providing spaced apart guide surfaces 3, 4. A discharge nozzle 13 is mounted on plate 8. This type of sliding closure unit normally includes a movable refractory plate mounted for reciprocal sliding movement between surfaces 3, 4. Such plate has therethrough one or more discharge openings adapted to be aligned with openings 11 to thereby discharge molten metal from vessel 1, or to block discharge openings 11. Such movable plate however is subjected to substantial corrosion and erosion as discussed above. In accordance with the present invention, such refractory sliding plate is replaced by a flexible gate component or movable control member 6 formed of a ceramic fiber material in the manner described above in detail. In the illustrated arrangement, control member 6 is in the form of a compressible web having therethrough a plurality of openings 5 spaced longitudinally of the web. The web 6 may be driven between surfaces 3, 4 of plates 7, 8 in the directions of double arrow 12, thereby moving web 6 into a blocking position shown in FIG. 1, or aligning a selected opening 5 with openings 11, thereby allowing discharge of the molten metal. A compression zone 9 is provided whereby the web 6 is compressed, thereby forming a seal with plates 7, 8, and also strengthening web 6 in the area between surfaces 3, 4.

Figure 2:
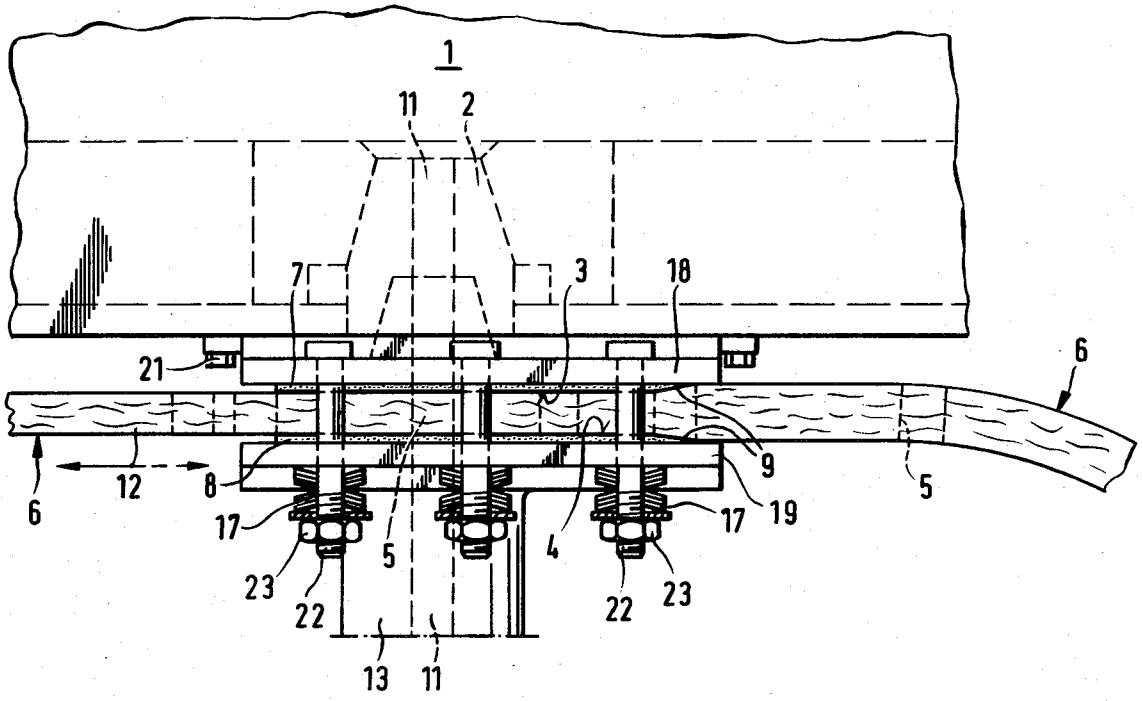
FIG. 2 is a side view of another embodiment of the present invention.

FIG. 2 shows a similar arrangement, but wherein guide surfaces 3, 4 are pressed toward each other against web 6 by the biasing force of springs. Compression zone 9 enables the web shaped fiber material 6 to be compressed while pulled in the direction of arrow 12. Plates 7 and 8 are secured by retaining means 18, 19.

Retaining means 18 is attached by means of bolts 21 to the bottom of the vessel 1, while retaining means 19 and plate 8 are biased toward web 6 by resilient cup springs 17 which may be designed to achieve a desired pressure. Regulation of the biasing force of the springs 17 is possible by adjustment of nuts 23 on bolts 22.

Figure 3:
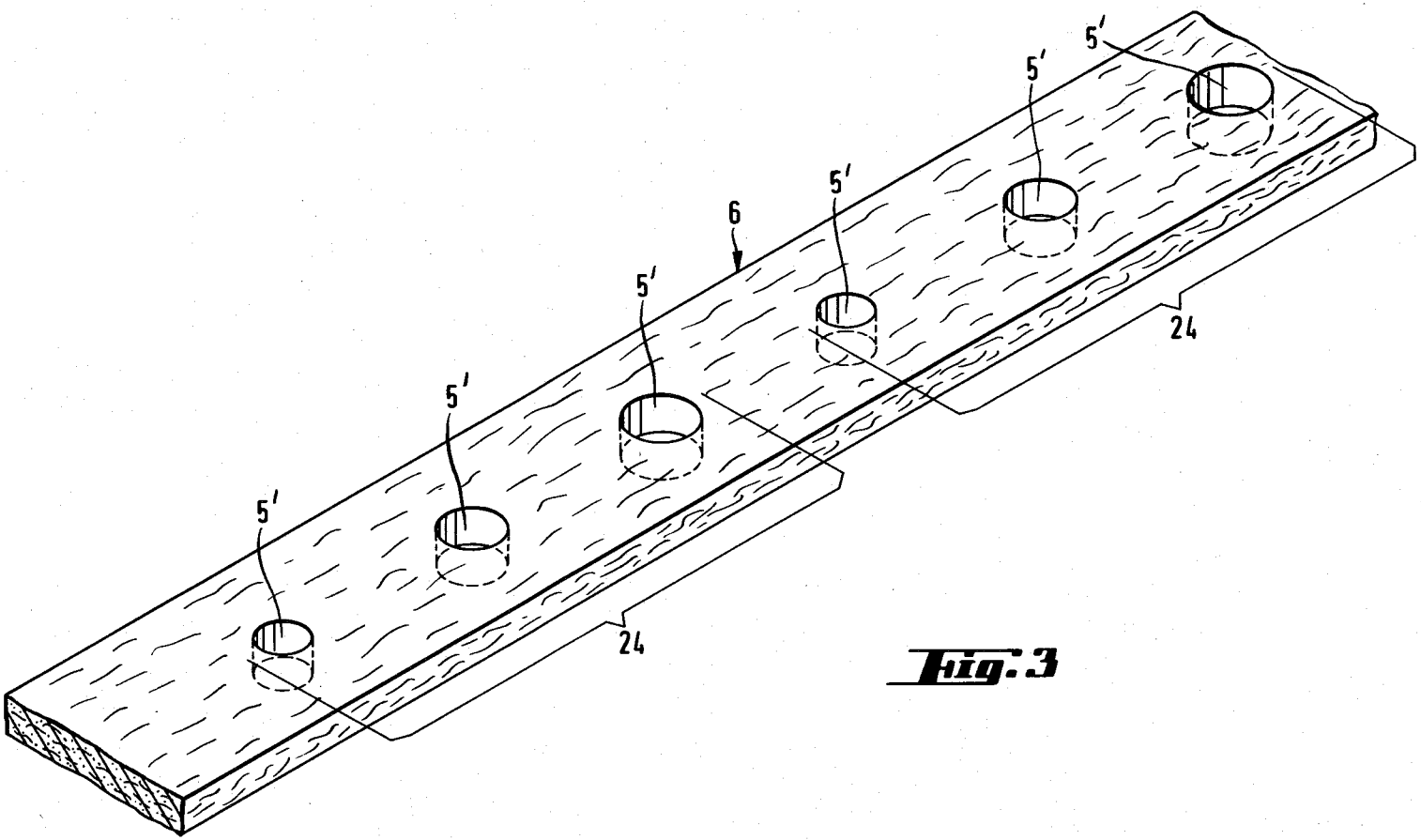
FIG. 3 is a perspective view of a portion of a web of material according to the present invention.

FIG. 3 shows an embodiment of the web 6 having therethrough groups 24 of flow through openings 5'. The openings of each group 24 have different diameters.

Figure 4:
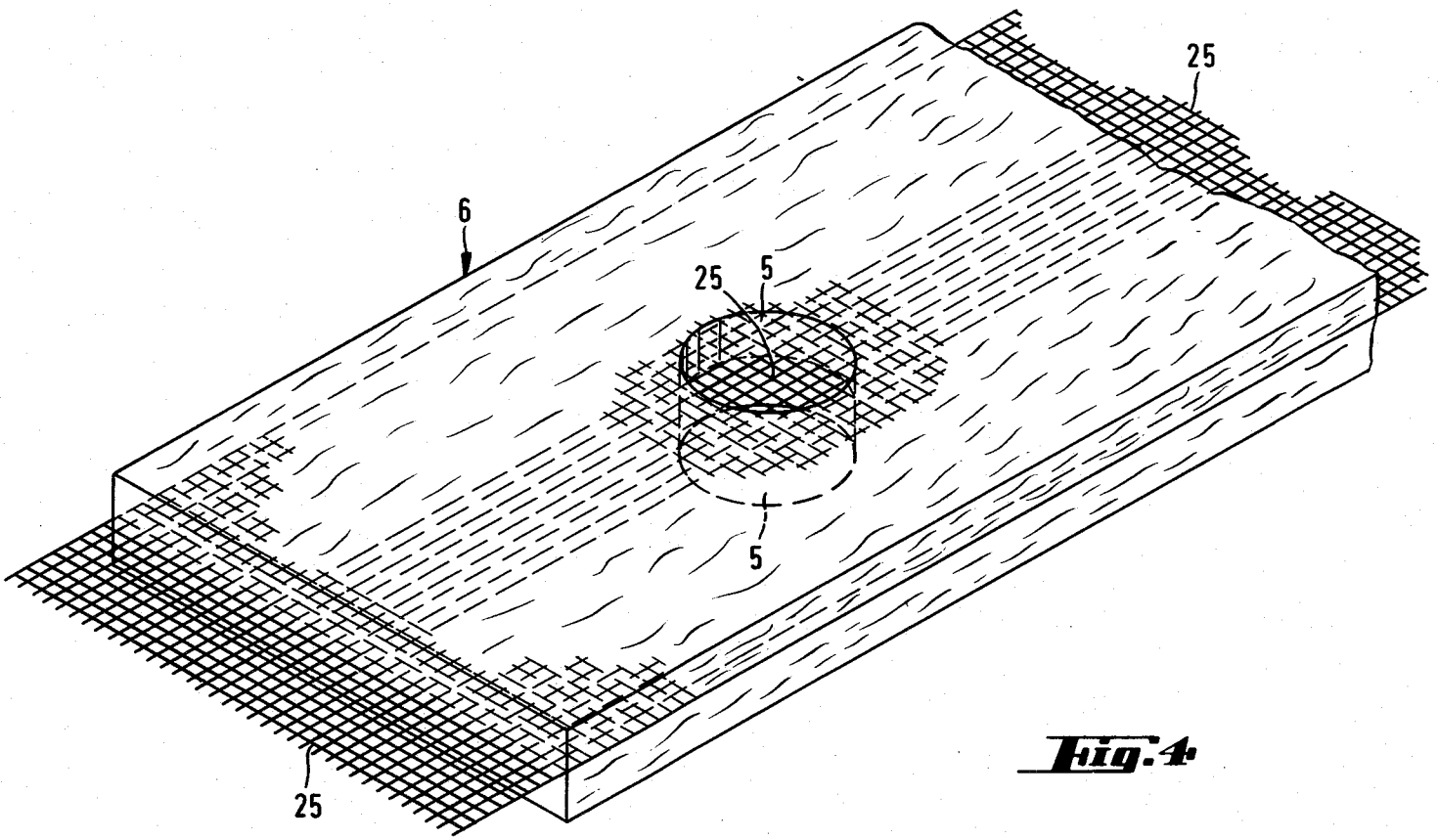
FIG. 4 is a partial perspective view of a modified web.

FIG. 4 shows a web 6 having embedded therein a flexible metal grid insert 25 which absorbs tensile forces. During use of opening 5 of the web, the grid at such area will rapidly melt away, without damaging the ability of grid 25 to ensure sufficient tensile strength in the area of opening 5.

Figure 5:
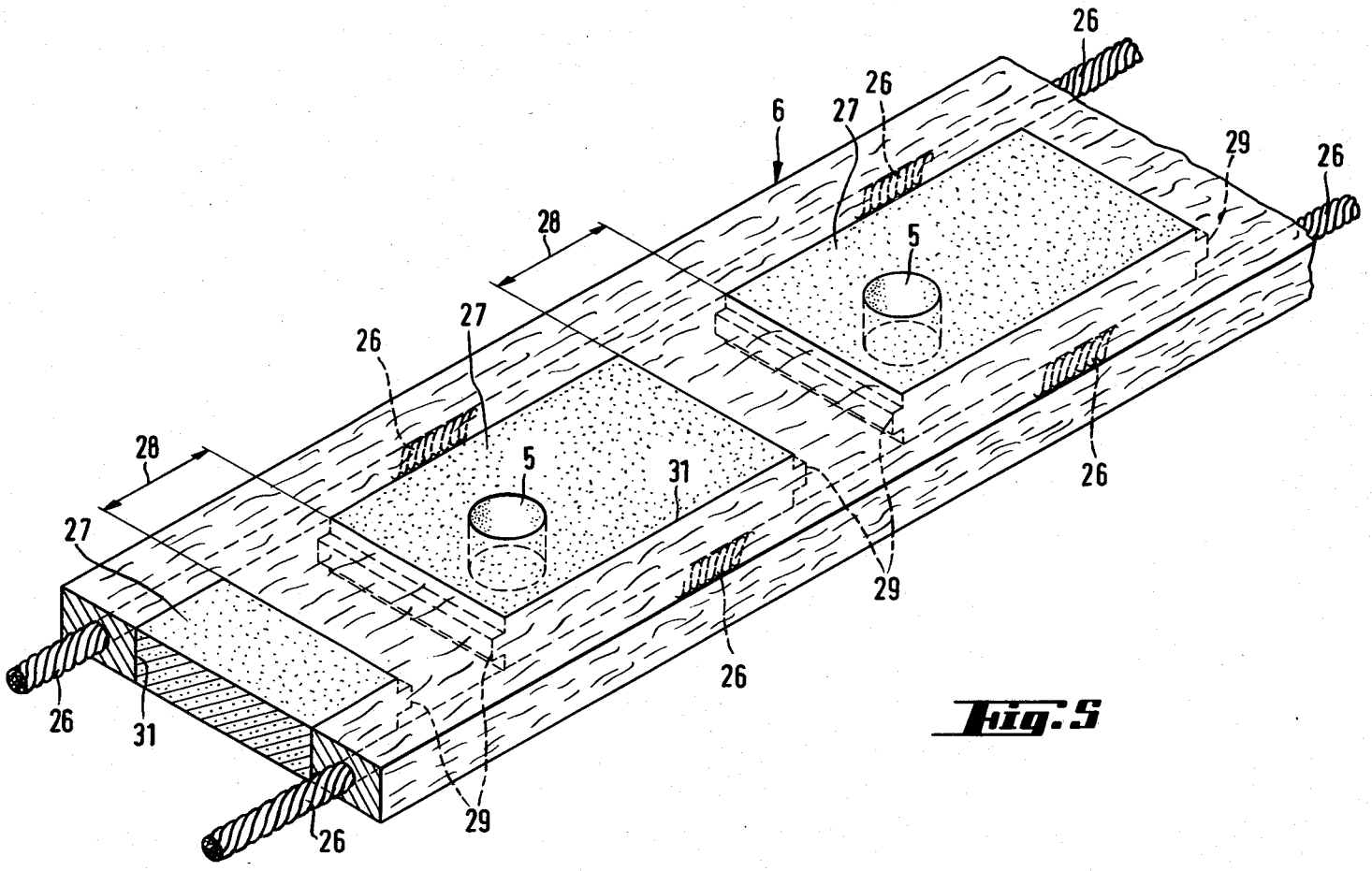
FIG. 5 is a perspective view of a further modified web.

FIG. 5 shows an embodiment wherein the tension resistant ropes 26, for example of heat resistant metal wire, are embedded in the web to absorb tensile stress. Elements 26 are located laterally of critical heating zones so that very high tensile forces can be exerted. Further, this Figure illustrates the provision, in the internal areas of the control web 6, high strength and temperature resistant inserts 27, which may be formed of conventional refractory materials. Intermediate areas 28 between inserts 27 remain fully flexible. Connection of inserts 27 to web 6 may be achieved in any suitable manner, for example by the tongue-and-groove arrangements 29 as shown. Lateral areas 31 between inserts 27 and web 6 remain free of such connection.

Figures 6, 7:
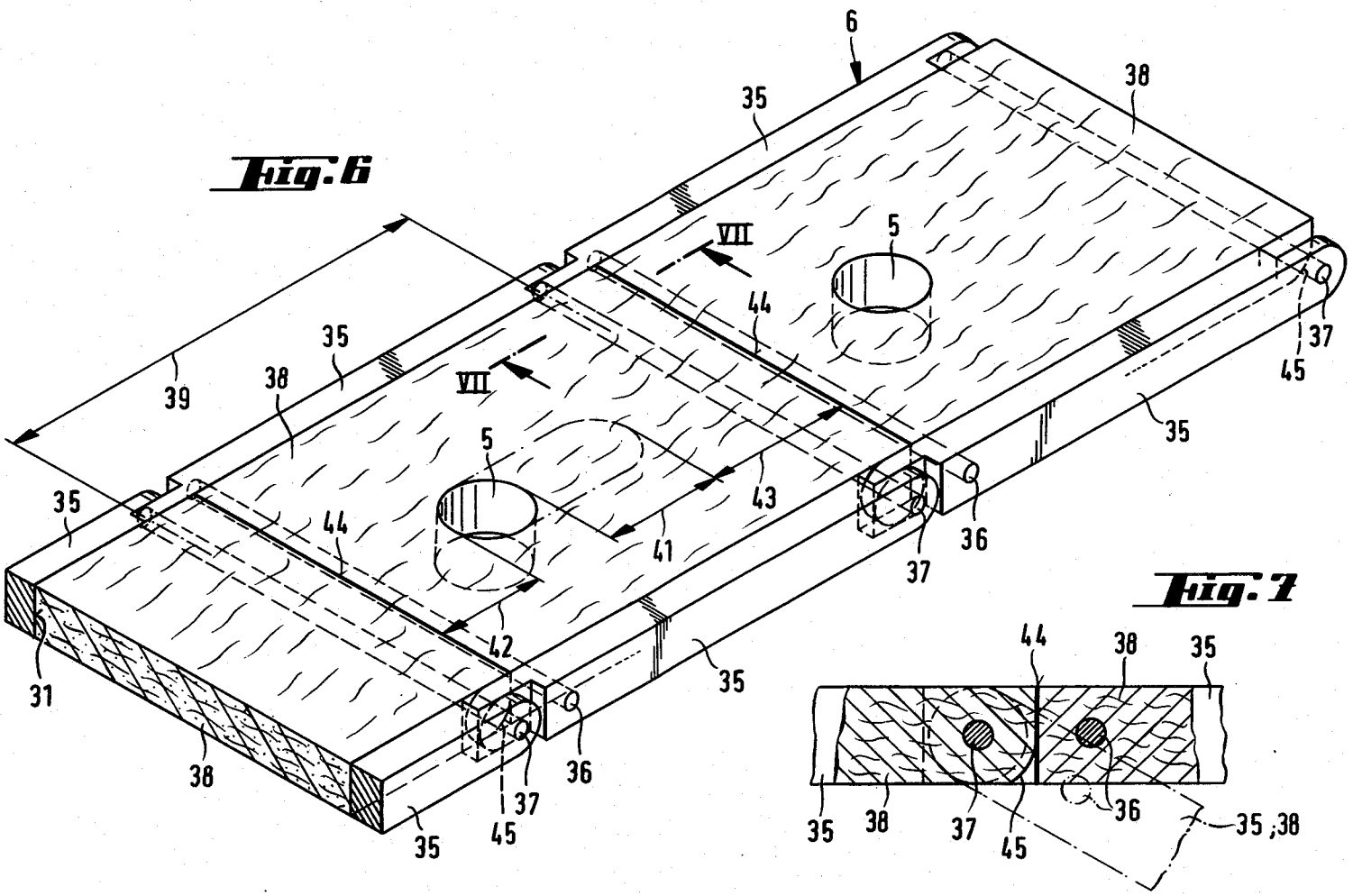
FIG. 6 is a perspective view of a further modified arrangement.
FIG. 7 is a cross-sectional view taken along line VII—VII of FIG. 6.

FIGS. 6 and 7 show an arrangement whereby the web is not longitudinally rigid but rather is flexible, for example by the provision of pivoted chain segments. Thus, the web 6 includes lateral high strength metal chain components 35 connected to ceramic fiber material portions 38, for example by pins 36, 37. The pitch 39 between segments may be provided relatively short so that the chain structure of the web may be rolled or wound. The chain pitch is determined by the diameter of opening 5, as well as conventional wearing area 41, and tolerance or safe dimensions 42, 43, dimensioned such that a joining area 44 is not placed in the area of openings 11. To enable pivoting, the lower trailing corner of each portion 38 may be rounded as shown at 45.

Figure 8:
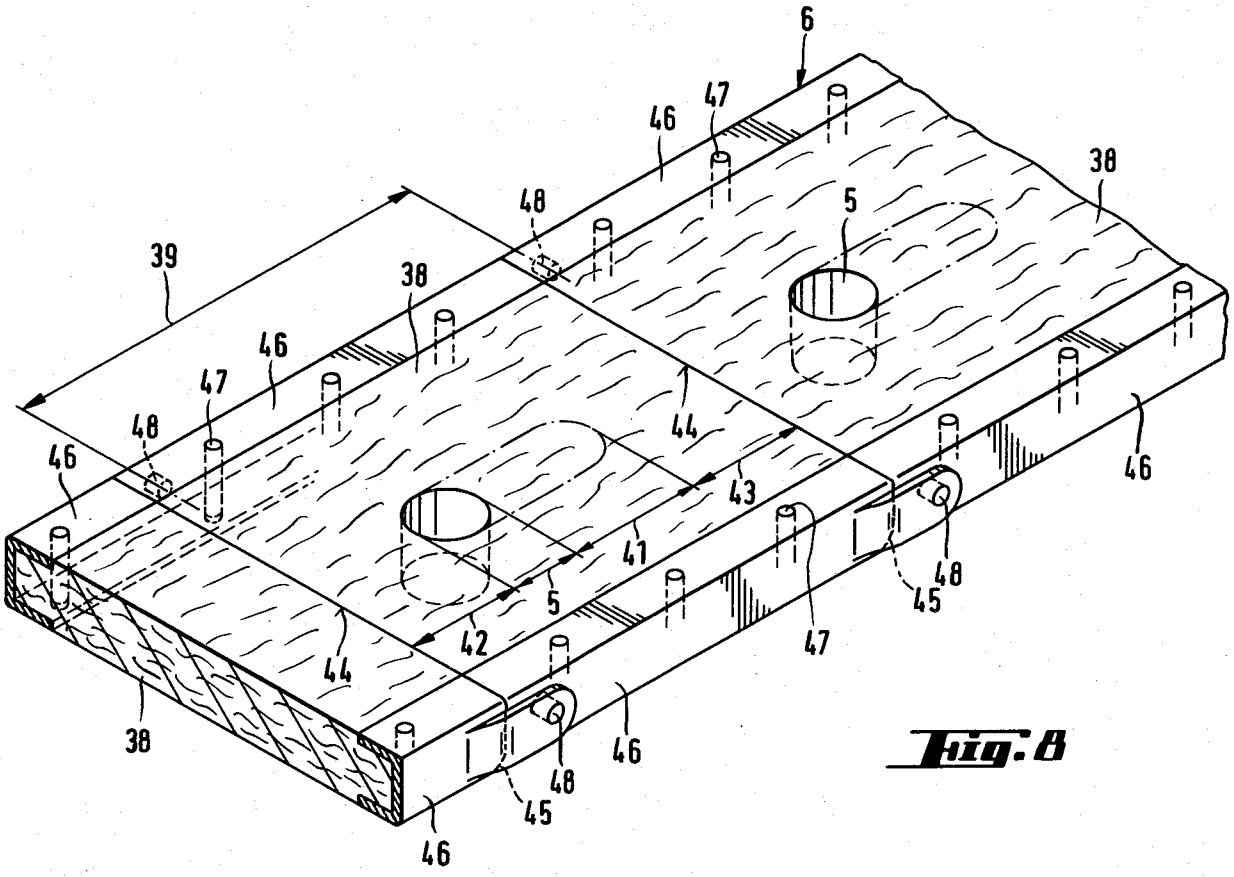
FIG. 8 is a perspective view of a further modified arrangement.

FIG. 8 shows an embodiment which is similar to that of FIG. 6, but without the provision of cross shafts 36, 37. The embodiment of FIG. 8 rather provides chain link elements 46 having a U-shaped section and vertical pins 47 and/or short pivot pins 48 for connection to ceramic fiber material sections 38. This arrangement makes it possible to shorten the pitch 39 so that the chain-type structure may be coiled.

Figure 9:
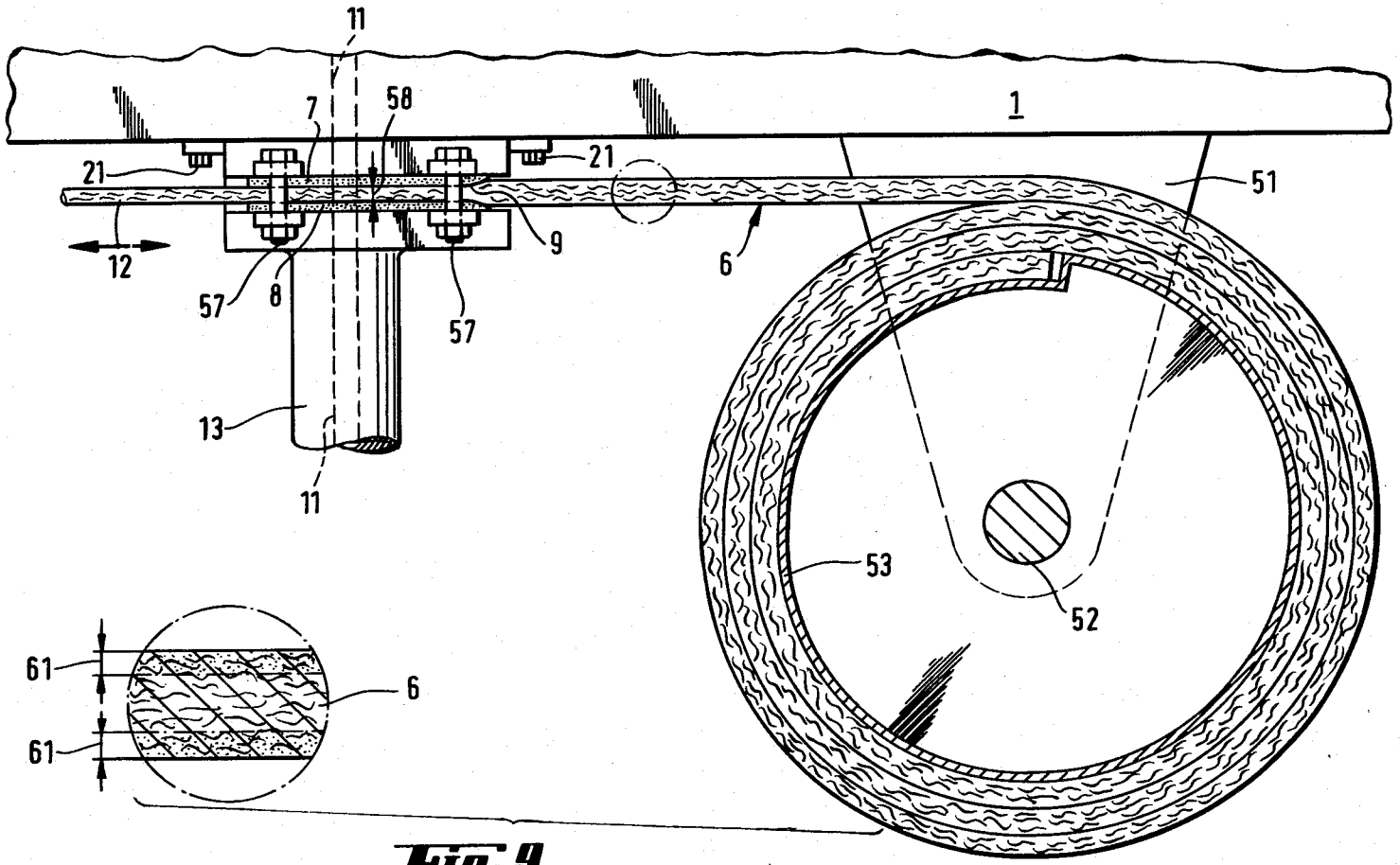
FIG. 9 is a side view similar to FIG. 2, but showing a further feature of the invention.

FIG. 9 shows an arrangement whereby a web 6 may be coiled on a drum 53 rotatably mounted on a shaft 52 supported by a bracket 51 beneath the vessel 1. The compression zone 9 and the gap 58 may be permanently set by bolts 57, whereby the web 6 may be pulled in the direction 12 as discussed above. The detail of FIG. 9 shows an additional feature of the invention wherein one or both sides of the web 6 may be provided with a layer 61 of a lubricant material, for example graphite.

Figure 10:
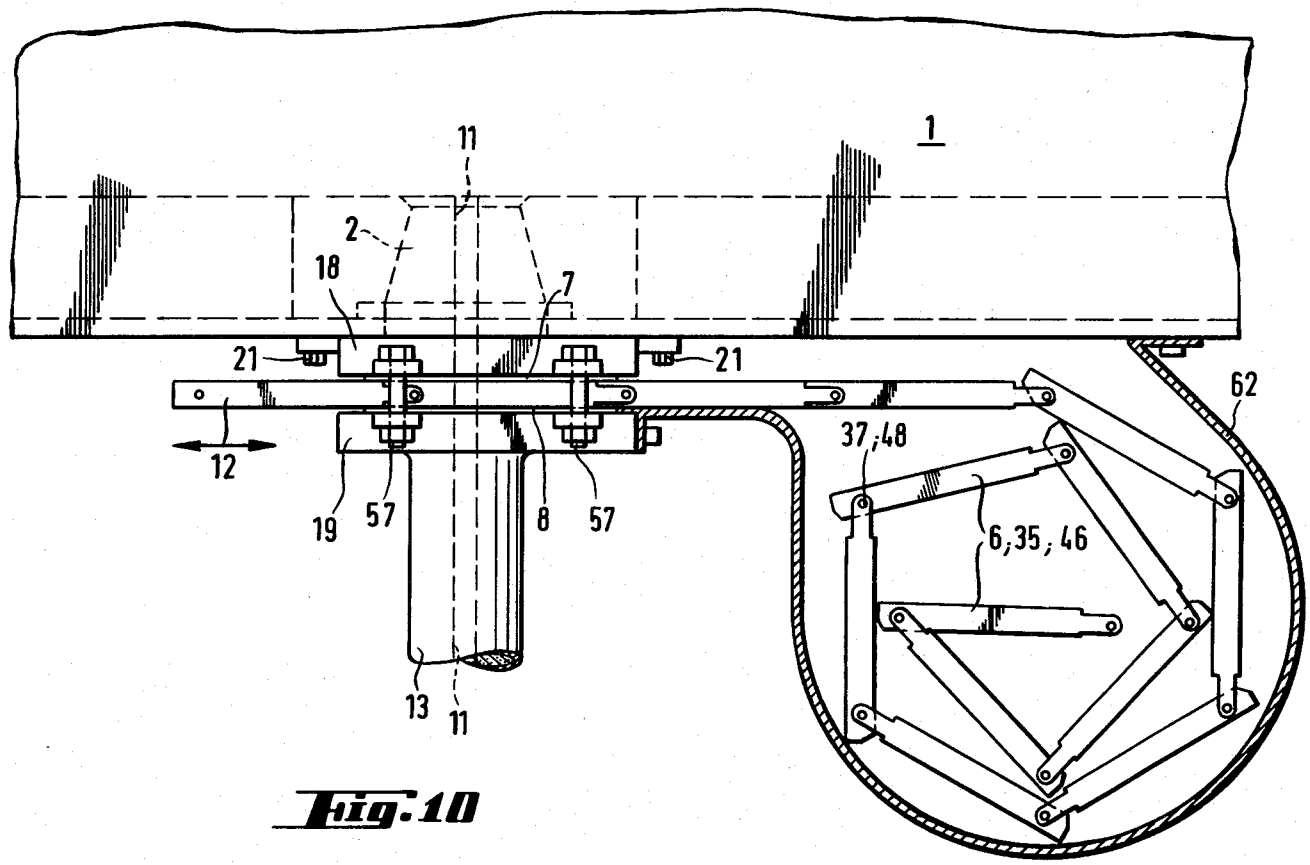
FIG. 10 is a view similar to FIG. 9 but showing a modified arrangement.

FIG. 10 shows a supporting arrangement for supporting the chain-type structures of FIGS. 6 or 8, and includes a receptacle 62 attached to the bottom of vessel 1 for housing the chain-type web 6.

Figure 11:
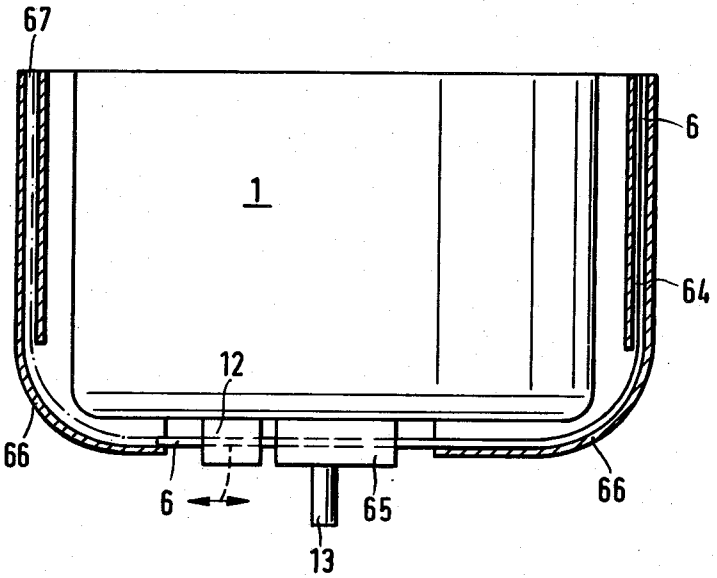

FIG. 11 illustrates an arrangement whereby an inlet bin 64 and an outlet bin 67 may be mounted about a vessel 1 for passage therethrough of the web 6, curved metal guides 66 guiding the web to and from a sliding closure unit 65.

Figure 12:
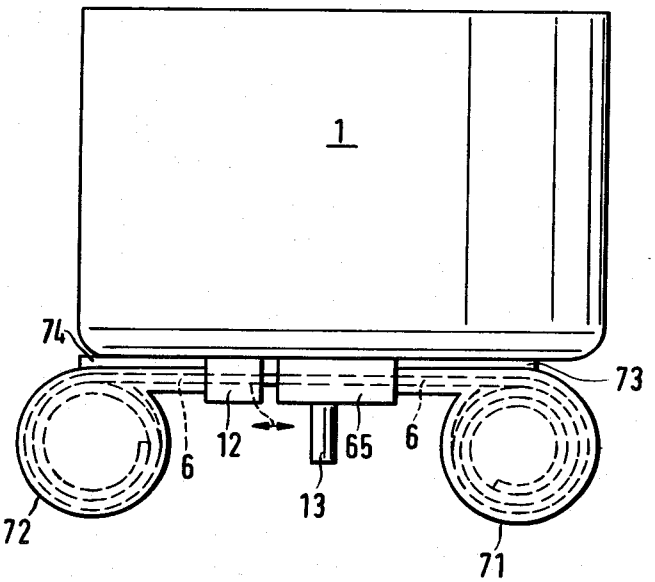
FIGS. 11 and 12 are schematic side views showing further modifications.

FIG. 12 shows an arrangement whereby the web may be supplied in the form of a cassette including dispensing and receiving portions 71, 72 mounted on the bottom of vessel 1, for example by flanges 73, 74.

Figure 13:
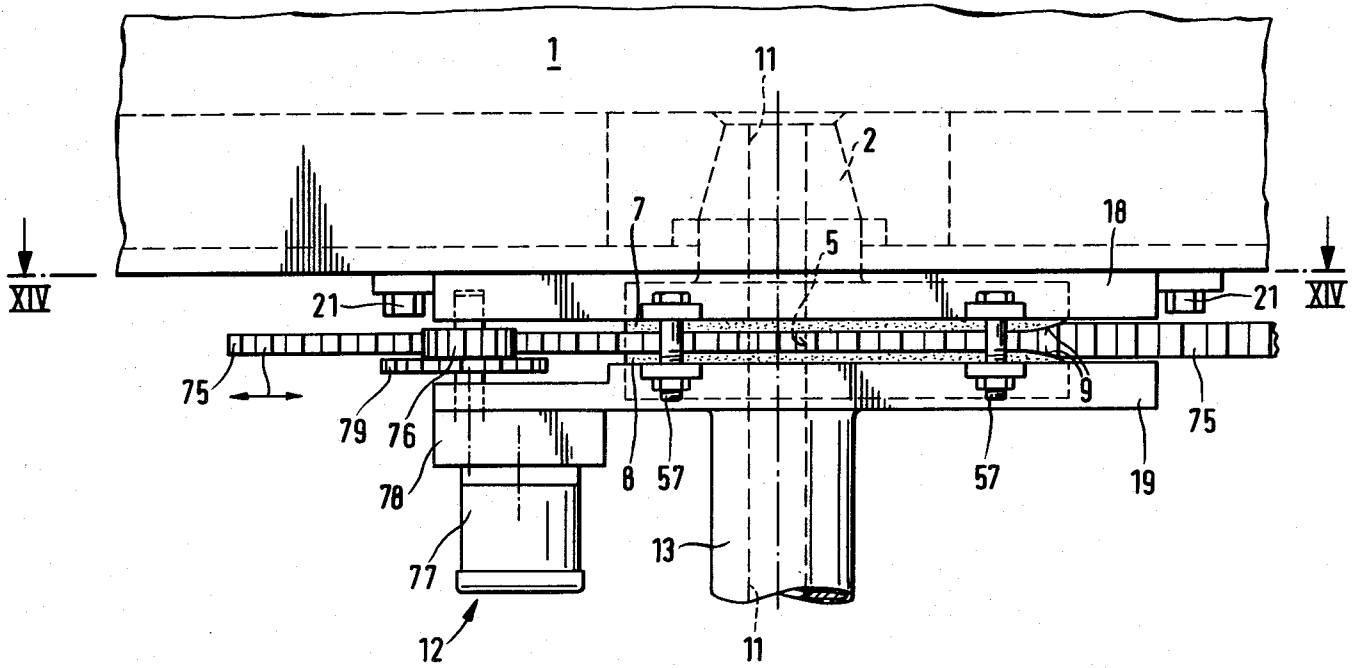
FIG. 13 is a side view of a further modification.
Figure 14:
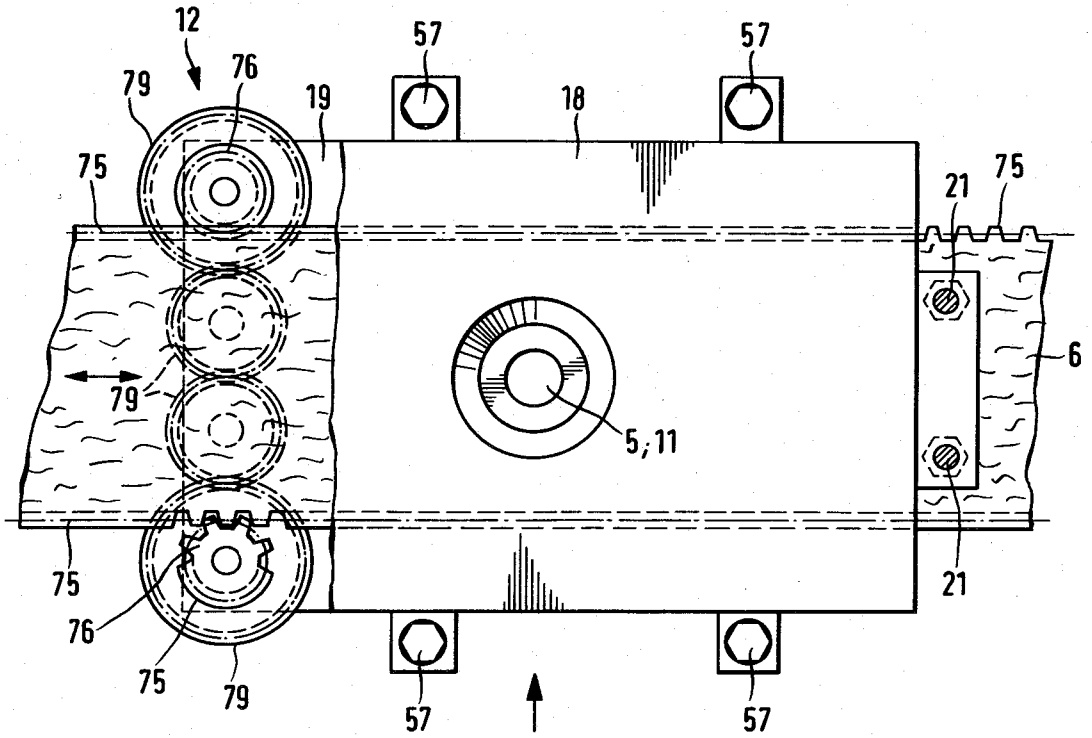
FIG. 14 is a sectional view taken along line XIV—XIV of FIG. 13.

FIGS. 13 and 14 illustrate a further embodiment of the present invention wherein the lateral edges of the web 6 are provided with teeth 75 which are engaged by driving gears 76 which act to pull the web between plates 7, 8. Teeth 75 may be formed in auxiliary metal elements connected to the sides of the web. Gears 76 are driven by gears 79 from a gear unit 78 and a motor 77.

Although the present invention has been described and illustrated with respect to preferred features thereof, various changes and modifications may be made without departing from the scope of the present invention.

What is claimed is:

1. In a sliding closure unit for controlling the discharge of molten metal from a metallurgical vessel, said unit being of the type including a pair of spaced guide members and a discharge control member movable between said guide members, said control member having therethrough at least one discharge opening to be moved into our out of alignment with a discharge opening of the metallurgical vessel, the improvement wherein said control member is formed of a ceramic fiber material, the proportion of fibers in said material being 40 to 90 weight percent.

2. The improvement claimed in claim 1, wherein said ceramic fiber material has a density of between 1.5 and 3.0 g/cm$^3$.

3. The improvement claimed in claim 2, wherein said density is approximately 2.0 g/cm$^3$.

4. The improvement claimed in claim 1, wherein said ceramic fiber material includes alumina fibers.

5. The improvement claimed in claim 4, wherein the alumina content of said fibers is greater than 45 weight percent and less than 98 weight percent.

6. The improvement claimed in claim 1, wherein said ceramic fiber material includes fiber mixtures of $Al_2O_3$-$SiO_2$.

7. The improvement claimed in claim 6, wherein the alumina content of said fibers is greater than 60 weight percent and less than 98 weight percent.

8. The improvement claimed in claim 7, wherein said alumina content is greater than 75 weight percent.

9. The improvement claimed in claim 1, wherein said ceramic fiber material includes $ZrO_2$ or carbon fibers.

10. The improvement claimed in claim 1, wherein the fibers of said ceramic fiber materials is at least one of carbon fibers, $Cr_2O_3$ fibers, $ZrO_2$ fibers or MgO-containing fibers.

11. The improvement claimed in claim 1, wherein the ceramic fibers of said material have an average length less than $1\times10^{-3}$ m.

12. The improvement claimed in claim 1, wherein the ceramic fibers of said material have an average diameter less than approximately 3 to $5\times10^{-6}$ m.

13. The improvement claimed in claim 1, wherein said ceramic fiber material has embedded therein a refractory bonding agent.

14. The improvement claimed in claim 13, wherein said bonding agent is a carbon-containing or carbonizable material.

15. The improvement claimed in claim 1, wherein said ceramic fiber material has added thereto between 0 and 30 weight percent of a pulverulent or colloidal refractory additive.

16. The improvement claimed in claim 15, comprising between 0 and 10 weight percent of said refractory additive.

17. The improvement claimed in claim 15, wherein said refractory additive is $Al_2O_3$, MgO, CaO, $SiO_2$, $SrO_2$, $Cr_2O_3$, SiC or graphite.

18. The improvement claimed in claim 1, wherein said ceramic fiber material has added thereto a refractory wetting-inhibiting agent.

19. The improvement claimed in claim 1, wherein said ceramic fiber material has added thereto a refractory lubricant.

20. The improvement claimed in claim 1, wherein said ceramic fiber material has a cold bending strength between about 4 and 10 $Nmm^2$ and a hot bending strength at 1500° C. between about 3 and 8 $Nmm^2$.

21. The improvement claimed in claim 20, wherein said colding bending strength is between 6 and 10 $Nmm^2$.

22. The improvement claimed in claim 1, wherein said control member is in the form of a plate or a web.

23. The imrprovement claimed in claim 1, wherein said plate or web has inserted therein at least one insert of a refractory material.

24. The improvement claimed in claim 1, wherein said control member is in the form of a web having therethrough plural said discharge openings spaced apart longitudinally of said web.

25. The improvement claimed in claim 24, wherein said web is compressible to form a seal with said guide members to accommodate the ferrostatic pressure of the molten metal.

26. The improvement claimed in claim 25, further comprising means for compressing said web between said guide members.

27. The improvement claimed in claim 24, further comprising tension resistant members embedded in or mounted on said web.

28. The improvement claimed in claim 27, wherein said tension resistant members are formed of heat resistant metal.

29. The improvement claimed in claim 27, wherein said tension resistant members are flexible or jointed.

30. In a sliding closure unit for controlling the discharge of molten metal from a metallurgical vessel, said unit being of the type including a pair of spaced guide members and a discharge control member movable between said guide members, said control member having therethrough at least one discharge opening to be moved into or out of alignment with a discharge opening of the metallurgical vessel, the improvement wherein said control member is formed of a ceramic fiber material having added thereto heat resistant metallic fibers of a length and diameter on the order of those of the ceramic fibers.

31. In a sliding closure unit for controlling the discharge of molten metal from a metallurgical vessel, said unit being of the type including a pair of spaced guide members and a discharge control member movable between said guide members, said control member having therethrough at least one discharge opening to be moved into or out of alignment with a discharge opening of the metallurgical vessel, the improvement wherein said control member is formed of a ceramic fiber material having embedded therein tar or pitch as a refractory bonding agent.

32. In a sliding closure unit for controlling the discharge of molten metal from a metallurgical vessel, said unit being of the type including a pair of spaced guide members and a discharge control member movable between said guide members, said control member having therethrough at least one discharge opening to be moved into or out of alignment with a discharge opening of the metallurgical vessel, the improvement wherein said control member is formed of a ceramic fiber material having metal or metal oxide vapor deposited on the ceramic fibers thereof or on surfaces thereof.

33. In a sliding closure unit for controlling the discharge of molten metal from a metallurgical vessel, said unit being of the type including a pair of spaced guide members and a discharge control member movable between said guide members, said control member having therethrough at least one discharge opening to be moved into our out of alignment with a discharge opening of the metallurgical vessel, the improvement wherein said control member is formed of a ceramic fiber material, said control member being in the form of a web having therethrough plural said discharge openings spaced apart longitudinally of said web, said discharge openings being of different diameter.

34. The improvement claimed in claim 33, wherein said discharge openings are arranged in order of increasing diameter.

35. In a control member for use in a sliding closure unit for controlling the discharge of molten metal from a metallurgical vessel, said control member being of the type having therethrough at least one discharge opening, the improvement wherein said control member is formed of a ceramic fiber material having added thereto heat resistant metallic fibers of a length and diameter on the order of those of the ceramic fibers.

36. In a control member for use in a sliding closure unit for controlling the discharge of molten metal from a metallurgical vessel, said control member being of the type having therethrough at least one discharge opening, the improvement wherein said control member is formed of a ceramic fiber material having metal or metal oxide vapor deposited on the ceramic fibers thereof or on surfaces thereof.

37. In a control member for use in a sliding closure unit for controlling the discharge of molten metal from a metallurgical vessel, said control member being of the type having therethrough at least one discharge opening, the improvement wherein said control member is formed of a ceramic fiber material, said control member being in the form of a web having therethrough plural said discharge openings spaced apart longitudinally of said web, said discharge openings being of different diameter.

38. The improvement claimed in claim 37, wherein said discharge openings are arranged in order of increasing diameter.

* * * * *